US005745916A

United States Patent [19]

Linner

[11] Patent Number: 5,745,916

[45] Date of Patent: May 5, 1998

[54] PROTECTIVE GLOVE FOR ICE-HOCKEY AND SIMILAR SPORTS

[76] Inventor: Hans Linner, Sellerberg 7, D-83370 Seeon, Germany

[21] Appl. No.: 545,634

[22] PCT Filed: Feb. 16, 1995

[86] PCT No.: PCT/DE95/00204

§ 371 Date: Oct. 24, 1995

§ 102(e) Date: Oct. 24, 1995

[87] PCT Pub. No.: WO95/22914

PCT Pub. Date: Aug. 31, 1995

[30] Foreign Application Priority Data

Feb. 24, 1994 [DE] Germany ..... 44 06 066.1

[51] Int. Cl.[6] ..... A41D 19/00

[52] U.S. Cl. ..... 2/16; 2/161.1

[58] Field of Search ..... 2/16, 18, 20, 159, 2/160, 161.1, 161.6

[56] References Cited

U.S. PATENT DOCUMENTS

| | | | |
|---|---|---|---|
| 3,626,515 | 12/1971 | Murray | 2/16 |
| 3,903,546 | 9/1975 | Rhee | 2/16 |
| 3,997,922 | 12/1976 | Huhta | 2/161.1 |
| 4,137,572 | 2/1979 | Jansson et al. | 2/16 |
| 4,287,610 | 9/1981 | Rhee | 2/161.1 |
| 4,400,829 | 8/1983 | Willis | 2/16 |
| 4,411,024 | 10/1983 | Hayes | 2/20 |
| 4,497,073 | 2/1985 | Deutsch | 2/16 |
| 4,930,162 | 6/1990 | Cote | 2/16 |
| 5,146,624 | 9/1992 | Bruckner | 2/16 |
| 5,237,703 | 8/1993 | Brine et al. | 2/16 |

*Primary Examiner*—Michael A. Neas

*Attorney, Agent, or Firm*—Cohen, Pontani, Lieberman & Pavane

[57] ABSTRACT

A protective glove for ice hockey and similar sports has padding for the hand region, wrist region, and at least in part for the forearm region, this padding being provided with elements promoting mobility of the joints. The padding is designed in the region of contact between the thumb and index finger in such a way that when the hand grips the shaft of a hockey stick the edges of the padding fit together substantially without gaps while leaving an opening for the shaft of the stick. The padding for the index, middle, ring, and little fingers is formed of one part which is movable in the proximal phalangeal region and is guided by only one finger and is divided transversely to the longitudinal direction of the fingers by one or more notches.

20 Claims, 10 Drawing Sheets

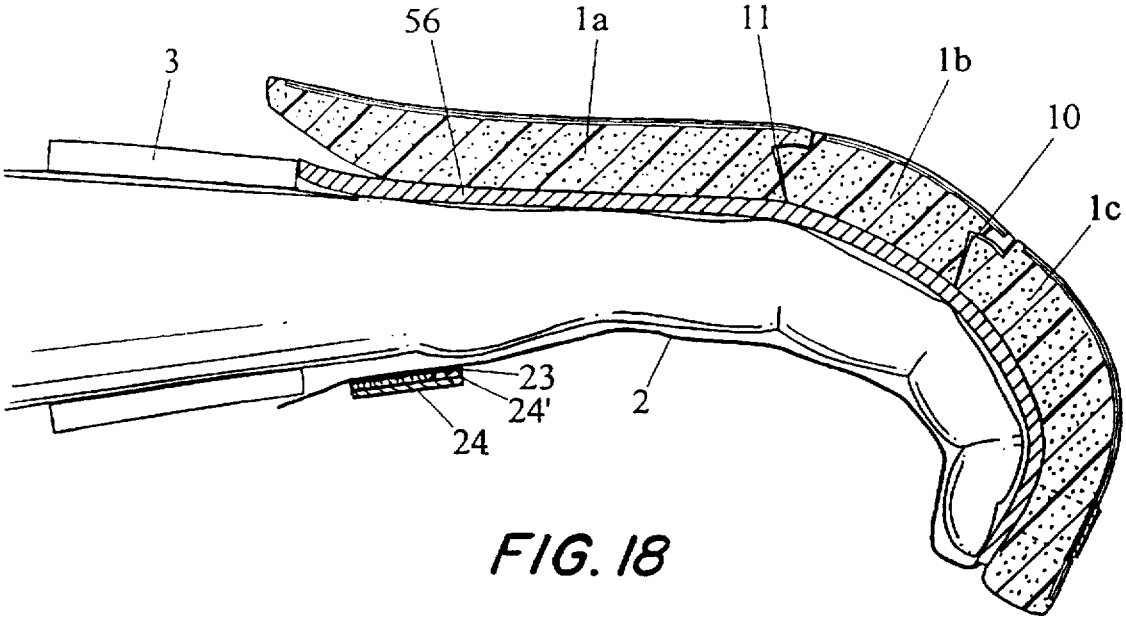
FIG. 18
FIG. 19
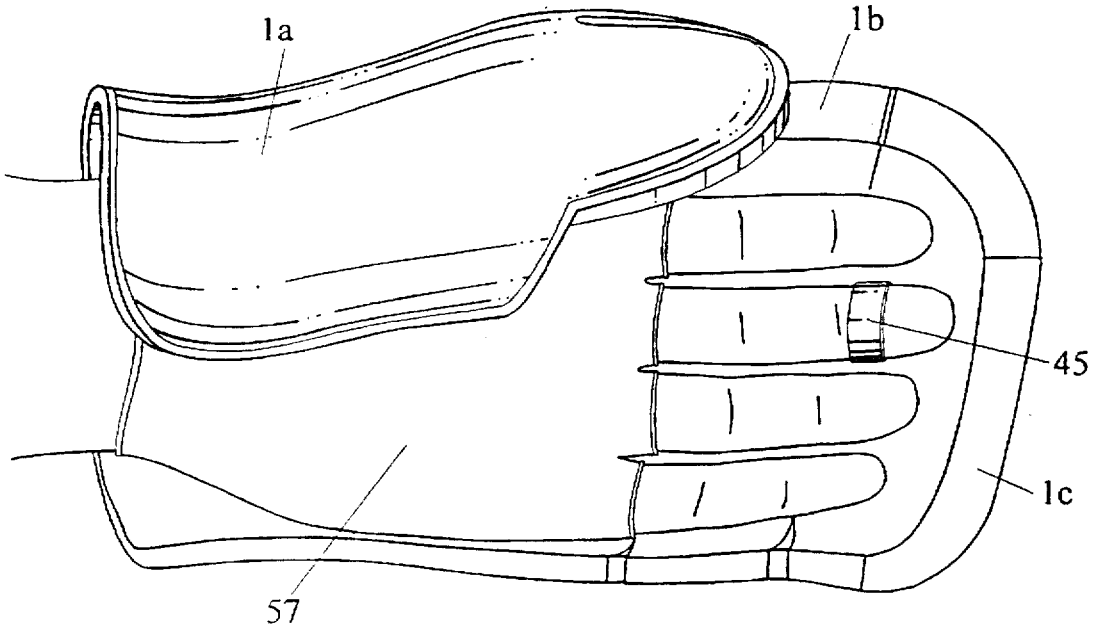

PROTECTIVE GLOVE FOR ICE-HOCKEY AND SIMILAR SPORTS

BACKGROUND OF THE INVENTION

The invention is directed to a protective glove for ice hockey and similar sports.

It is known that in sports such as ice hockey, lacrosse, roller hockey, etc. the player's hands are exposed during play to considerable impact forces from the stick of an opponent. For this reason, it is customary to protect the player's hands and forearms with padded protective gloves having a shaft or shank for protecting the forearm. These protective gloves also protect the player's hands from injury due to falls on the ice or the ground.

Ice hockey gloves of the kind mostly used and manufactured at present are known from U.S. Pat. No. 4,027,339 (Brucker), U.S. Pat. No. 4,677,698 (Angas), U.S. Pat. No. 4,815,147 (Gazzano), and U.S. Pat. No. 4,930,162 (Cote). These gloves are substantially formed of padding elements having a thickness of approximately 2 cm for protecting the backs of the hands and a padding element for the index, middle, ring and little fingers, respectively. The padding elements have notches in forms which vary from one model to the other in order to achieve the required flexibility for gripping the stick. The thumb protection is usually formed by a relatively hard plastic shell with internal padding. A padded shank part adjoins the padding for the back of the hand and protects the foremost part of the forearm. The inner surface or palm of this known ice hockey glove is stitched securely to the protective parts of the back hand surface, finger and shank. This palm is made of leather or a material similar to leather and is often constructed in two layers in some regions of the inner hand.

One problem in this known ice hockey glove consists in that the padding of the index finger presses against the thumb protection when the hand grips the shaft of the stick. Accordingly, an unencumbered, comfortable grip is impossible and the stick cannot be gripped in an optimum manner. Further, a certain expenditure of force is required in gripping the shaft of the stick since, in so doing, the padding of the individual fingers and the lateral protection of the index finger, as well, impose a resistance against an embracing grasping of the shaft of the stick. This is particularly true of newly manufactured gloves which are not yet "broken in". For this reason, ice hockey players—particularly professional players—are very reluctant to use new gloves.

A striking illustration that conventional ice hockey gloves do not enable a free, unimpaired gripping of the shaft of the stick is indicated by the fact that many players hold their index finger away when holding the shaft of the stick—that is, they do not use the index finger for gripping. The reason for this is that the parts protecting the thumb and index finger are not adapted to one another in shape.

A further drawback of conventional ice hockey gloves lies in the fixed stitching of the palm. This palm is exposed to very substantial wear owing to constant gripping of the stick. Accordingly, the useful life of the entire glove is determined chiefly by the durability of the palm. This means that a worn palm renders the gloves useless although the remaining parts are still in good condition and would have twice or three times the useful life. Although it is possible to cut out the damaged palm and stitch in a new one, this would very rarely be done as it is very labor-intensive and requires special machinery. Another possibility to increase the useful life of the glove would be to increase the size, i.e., the thickness, of the palm. However, this would result in the decided disadvantage that an ice hockey player with such a glove would have considerably less feeling for holding and guiding the stick which could result in game-deciding disadvantages for the player and his teammates.

A satisfactory compromise cannot be reached. If a thick palm is used, the useful life is increased, but at the expense of a substantially diminished feel for holding the stick. Use of a thin palm results in a more sensitive feel for holding the stick, but it becomes worn in a comparatively short time and renders the entire glove unusable. As a result of the existing compromise in the form of a comparatively thick palm which is even partially constructed with multiple layers, there is less feeling for holding the stick as well as a comparatively short useful life.

Another disadvantage is inadequate protection of the index, middle, ring and small finger. Since every finger has an individual padding strip, the force of a blow dealt by an opposing player, for instance, is distributed over only a comparatively small area. This can lead to contusion or fracture of a finger. Further, the notches or slits between the padding elements on the back of the hand which enable the hand to perform gripping movements represent substantial weak points in which, for instance, the thin blade end of the ice hockey stick can penetrate and lead to injuries.

The lateral protection of the index finger and little finger cannot be considered a satisfactory solution. Since a thicker padding in this region would cause an even greater impediment to bending the fingers and accordingly to gripping the stick, these locations are generally provided with only comparatively thin padding elements. This has disadvantageous consequences especially for the index finger, since the latter is very often exposed to blows.

Further, the freedom of movement of the wrist is impeded by the shank construction of conventional ice hockey gloves. For this reason many players have begun to remove the straps from the shank in order to achieve greater mobility for the wrist. However, this substantially diminishes the protection of the front forearm and could result in serious injuries.

A further disadvantage of the common ice hockey glove consists in the very labor-intensive manufacture, since they are formed of a very large number of widely differing individual parts and materials, all of which must be connected by a multiplicity of stitches.

Another type of glove is described in U.S. Pat. No. 4,137,572 (Jannson). In this case, also, the problem consists in that the palm is stitched together with the rest of the parts in a stationary manner resulting in the drawbacks described above. Moreover, the padding lacks sufficient protective action. This is due to the layer construction in which the outer and inner layers are made of a relatively soft material, while a hard and relatively rigid material is inserted between these layers. The protective function is not optimum since the region over which impact force, e.g., originating from an opponent's stick, is distributed is not as large as it would be if the rigid material were arranged entirely on the outer side. Further, a certain expenditure of force is required with this type of glove when closing the hand or holding a stick in spite of the improved construction in the knuckle region. Thus, it is impossible to grip the shaft of the stick in an unimpaired, comfortable manner. Moreover, the shape of the finger protection is also not adapted to the shape of the thumb protection.

Another type of ice hockey glove is described in U.S. Pat. No. 3,605,117 (Latina). This ice hockey glove is formed of four parts, namely an inner glove, a padding part for the back of the hand and the fingers, a side part for protecting the thumb, and a shank for protecting the lower forearm. These four parts are connected with one another by straps of leather or a similar material. Although this construction has the advantage of an exchangeable inner glove, it has grave disadvantages as a whole. Firstly, it is cumbersome and also difficult to exchange the inner glove since all four parts must be separated for this purpose and then connected again via a large number of straps. Secondly, force must be expended to bend the finger padding when curving the fingers, which results in the familiar disadvantage regarding control of the stick. Thirdly, the shank construction limits mobility in the region of the wrist. Fourthly, this type of glove proves to be very costly to manufacture since it is formed of a very large number of parts which must be connected in many work steps. Fifthly, the protective function is deficient. A broad, unpadded and accordingly unprotected area occurs at the connecting point between the shank and the padding for the back of the hand. Further, it lacks lateral protection at the index finger and little finger, which again can result in substantial injuries. The sum of these deficiencies is probably also the reason that this type of glove has not had commercial success.

SUMMARY OF THE INVENTION

The present invention has the object of providing a protective glove for ice hockey and similar sports which enables substantially more sensitivity for holding and controlling an ice hockey stick and also has an improved protective function.

This object is met according to the invention in that the padding is so designed in the region of contact between the thumb and index finger that when the hand grips the shaft of the stick its edges fit together substantially without gaps while leaving an opening for the shaft of the stick. The protective glove accordingly has a padding which is so shaped that a protection which fits together without gaps is formed in the region between the thumb and index finger when closing the hand. That is, the invention improves both protective action and mobility of the player's hand in that a homogeneously constructed and shaped protective shell is connected with a special glove provided with fingers, hereinafter called "inner glove", so as to be quickly detachable.

The overall construction of the ice hockey glove according to the invention is based on the following fundamental considerations. From the standpoint of optimum handling of the ice hockey stick, a thin glove provided with fingers and fitting snugly over the bare hand or the bare hand by itself would be the ideal solution. However, effective protection against impact is indispensable in ice hockey. Thus it is necessary to shape a protective shell which encloses all parts of the hand exposed to impact and which follows the anatomy of the hand and its typical postures in the course of play. The protective shell must satisfy the requirement for the greatest possible absorption of impact force while simultaneously having as little weight and volume as possible. Further, the shape in the interior must be effected in such a way that it does not interfere with the sensitive motor functions of the hand on the shaft of the stick and the shape must be designed so as to be inherently articulated in such a way that it permits the necessary, desired gross motor functions such as opening the hand for gripping the stick or stopping the puck or, e.g., also gross adjustment of the playing equipment.

In addition, it is important that the protective shell be securely connected with the hand and with the inner glove worn on the hand. For this purpose, the connection must be designed so that it does not restrict the gross and sensitive motor functions specific to ice hockey, the connection is stable, and the protective function is not impaired. Thus, the essence of the invention consists in satisfying two disparate requirements in one functional unit.

The protective shell of the glove according to the invention is shaped in such a way that all parts of the hand which are exposed to impact when gripping the shaft of the stick are enclosed. In addition, the protective shell is so constructed that it can absorb the maximum predictable impact force and so distribute this force that no injury can result on the hand covered by it. It is practical, in contrast to conventional ice hockey gloves, to construct all protective parts in an identical manner since the impact force is naturally not governed by which parts of the hand are better protected or by the frequency with which a certain part is struck. A fine-celled foamed, stable-resilient substance which is protected on the outer side by thin, hard plastic plates is viewed as the optimum protection against impact. These plates distribute the impact force over a larger area so that it does not penetrate the underlying foam layer in an injurious manner.

The shape of the protective shell is determined by the anatomy of the hand itself and especially by the variations of hand posture occurring in play. It is therefore constructed so as to be movable in the joint region of the fingers, whereas a stationary and unified protective shield is formed over the back of the hand, the thumb, and ball of the thumb. A two-part finger shield adjoins the protection on the back of the hand in a movable manner. The protective effect in the finger region is accordingly substantially increased because the space between the fingers which would otherwise be open can no longer be threatened, for instance, by the penetrating blade of a hockey stick and because occurring blows can be distributed over a larger surface area.

The articulated connections are designed as folding constructions which fit one into the other and which, in contrast to conventional protective gloves, do not form any typically open notches even when the fingers are bent to the maximum degree. When the hand is closed around the shaft of the stick, the finger shield and main shield fit into one another in such a way that an integral protection without gaps is produced around the entire fist—with the exception of the palm which is necessarily open—in the region between the thumb and index finger.

The shape of the ice hockey glove according to the invention is accordingly so executed that it has no projections or edges. The risk of injury due to entanglement in the jersey of another player, for example, is minimized in this way. The interior of the protective shell is shaped in such a way that all typical movements of the hand relative to the forearm can be executed easily and without resistance. The finger shield follows the curvature of the finger. In the preferred embodiment example, only the middle finger guides the finger shield. This means that all fingers can be moved individually so as to enable sensitive motor functions and—with the exception of the middle finger—practically without resistance. A theoretical restriction exists in that the index finger, ring finger and little finger cannot stretch beyond the extent of the middle finger, but these movements are without importance in ice hockey.

When the hand closes around the shaft of the stick, the protective shell also closes without leaving gaps. There is sufficient space within this shell to allow the player to position each finger on the shaft of the stick individually, without impairment and in an optimum manner.

The selection and placement of the connection points between the inner glove and protective shell are based on the following considerations. On the one hand, there should be enough connecting points at selected locations for a reliable guidance of the protective shell on the hand. On the other hand, the number of connection points should be small enough and the connecting locations so selected that the hand has optimum freedom of movement within the protective shell. As a result, the following placement is preferable: one connection in the thumb region, in addition to the middle finger connection, and two connecting locations at the back of the hand. These four connection points, together with a strap which can be fastened at the wrist, reliably hold the protective shell on the hand without limiting the freedom of movement.

The problem of protecting the transitional region from the hand to the forearm is solved in principle by designing a separate and specifically adapted protection for each articulated body part. The two protective elements cooperate in such a way that an unimpaired movement is enabled without leaving gaps exposed to impact. A separate forearm protection extending up close to the wrist is provided for this purpose. The spacious protective shell for the hand overlaps with the front end of the forearm protection to the extent that the characteristics mentioned above are achieved in equal measure.

In summary with respect to freedom of movement it can be said that the ice hockey glove according to the invention permits all movements of the hand and fingers tailored to ice hockey to a degree which far surpasses the possibilities offered by conventional gloves. In a directly related manner, this means increased control over the stick through greater sensitivity in the hand resulting in more effective and accordingly more successful play.

The favorable union of the two main criteria of the invention leads to a third substantial improvement over the prior art. The newly developed ice hockey glove can be adapted to the most varied needs and tastes of the user in an extremely economical manner since a standardized protective shell can be used with inner gloves providing many possible user-adapted combinations by way of different sizes, materials, grip linings and styles.

This leads, in turn, to aspects of practicality and comfort. For example, a player may procure several pairs of inner gloves of different design and change them depending on external requirements or personal preference. For instance, it may be practical to wear two different inner gloves on the left and right hand, since the hand guiding the middle part of the shaft of the stick is constantly shifted, while the hand guiding the end of the shaft essentially retains its gripping position. It is also possible to change a perspiration-soaked inner glove during a pause in the game. Finally, it is possible to use inner gloves in which the fingers are partially or entirely cut away without impairing the protective effect.

Further, the exchangeable inner glove eliminates the glaring economic disadvantage of conventional hockey gloves that their useful life is determined by the weakest component, the wear-prone palm. A protective glove independent of the inner glove need only be discarded when it becomes so worn that it no longer fulfills its protective function. The useful life of the protective glove can be increased many times over in this way.

In contrast to conventional designs which must be broken in over a long period, an ice hockey glove of this kind is fully functional from the first day of use. This disadvantage is illustrated in conventional gloves by the fact that many players use new gloves at first only during training in order to reduce competitive disadvantages caused by stiff gloves which have not been broken in.

The unified construction of the protective glove according to the invention results in advantages with respect to manufacture since the number of materials used, the number of individual parts, and the length of the stitches are appreciably reduced. The number of work steps is also considerably reduced so that production costs can be cut back enormously.

The invention is explained more fully in the following with reference to embodiment examples shown in the drawing.

BRIEF DESCRIPTION OF THE DRAWING

FIG. 18 shows the protective glove of FIG. 4 with a thin padding on the glove at the back of the hand and fingers;

FIG. 19 shows the protective glove with a fingerless inner glove;

DETAILED DESCRIPTION OF THE PREFERRED EMBODIMENTS

In a first embodiment example shown in FIGS. 1 to 9, the glove is formed of three parts, namely padding 1, an inner glove 2, and a separate forearm protection 3.

Figure 4:
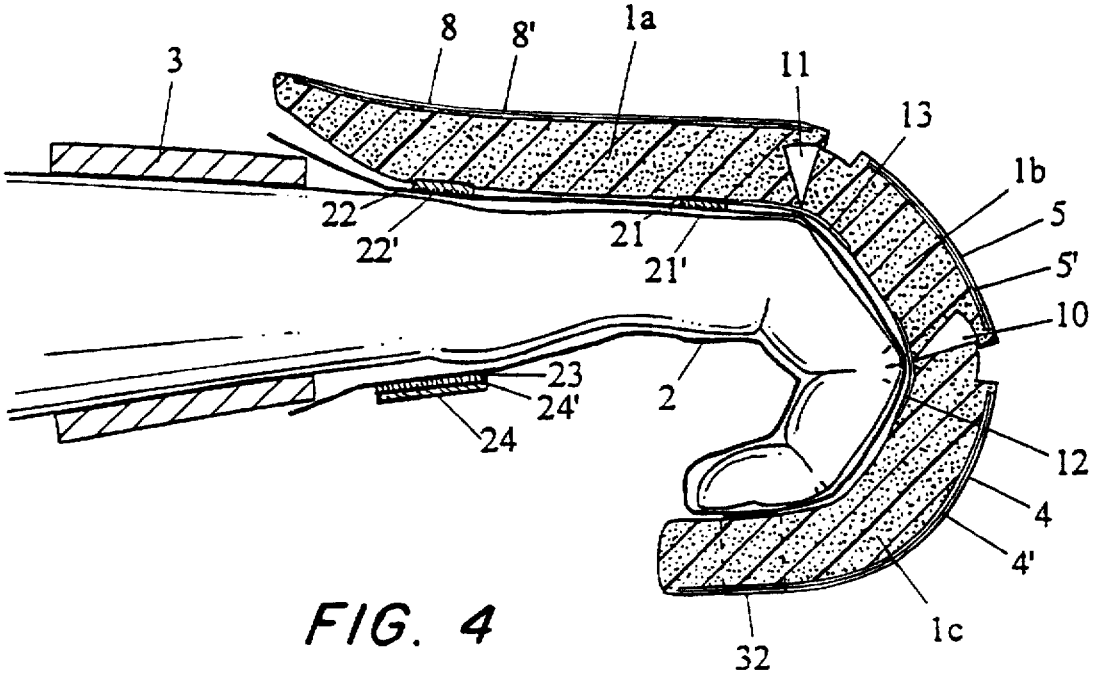
FIG. 4 shows a section 4—4 from FIG. 1 with closed hand.

The construction of the padding 1 is shown in FIG. 4. It is preferably made of a mold-foamed polyurethane in which plates are embedded on the outer side. These plates are made of comparatively rigid plastic 4', 5', 6', 7', 8', 9', e.g. ABS plastic, which is glued to leather 4, 5, 6, 7, 8, 9. As a result of the plastic part, impact force occurring in a punctiform manner is distributed along a large surface of the foamed material so that very high impact forces can be absorbed without resulting in injury. A visually attractive wear-resistant surface is achieved by the leather layer on the outside.

Figure 5:
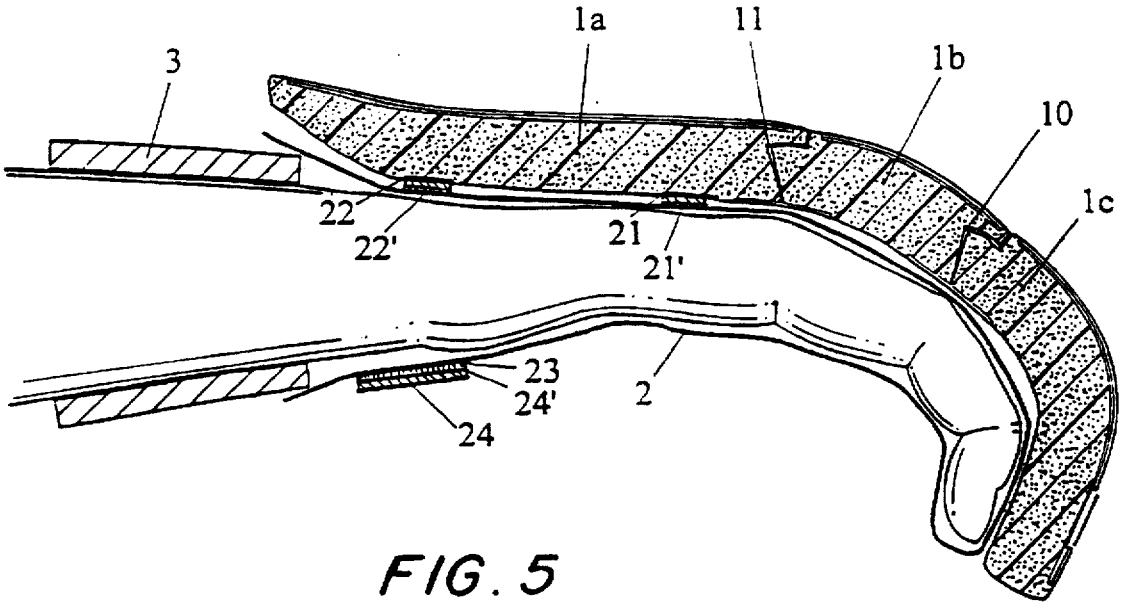
FIG. 5 shows section 4—4 from FIG. 1 with open hand.
Figure 6:
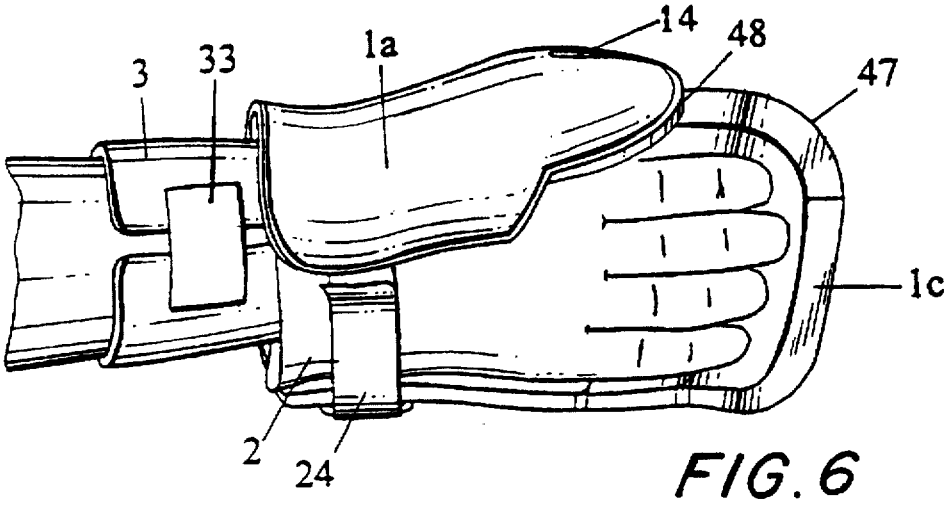
FIG. 6 shows the protective glove with open hand.
Figure 7:
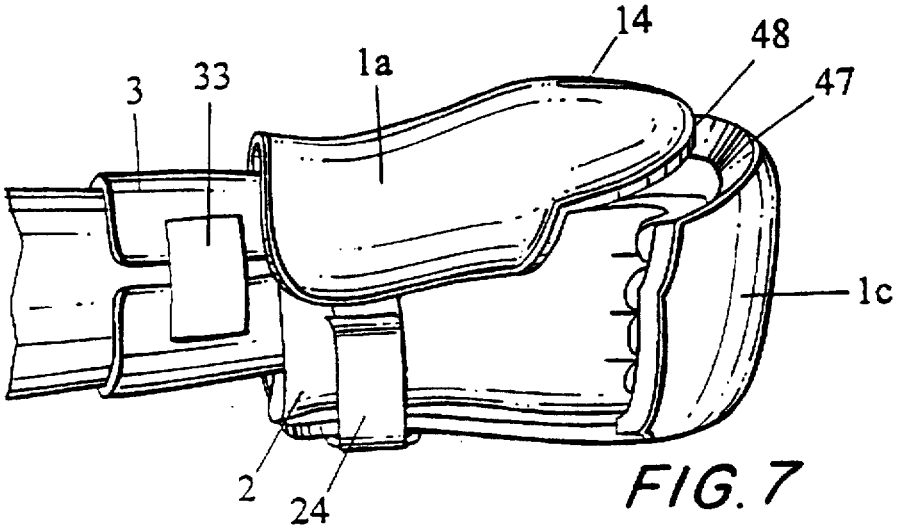
FIG. 7 shows the protective glove with a half-closed hand.
Figure 8:
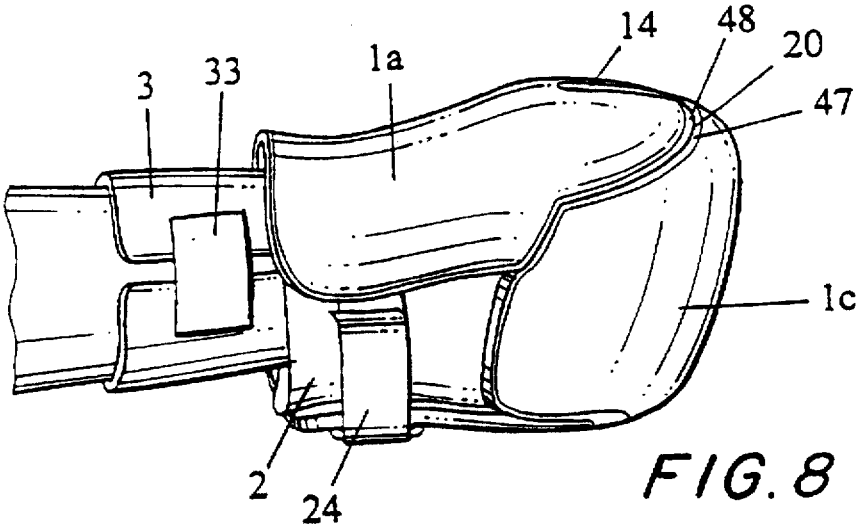
FIG. 8 shows the protective glove with closed hand.
Figure 9:
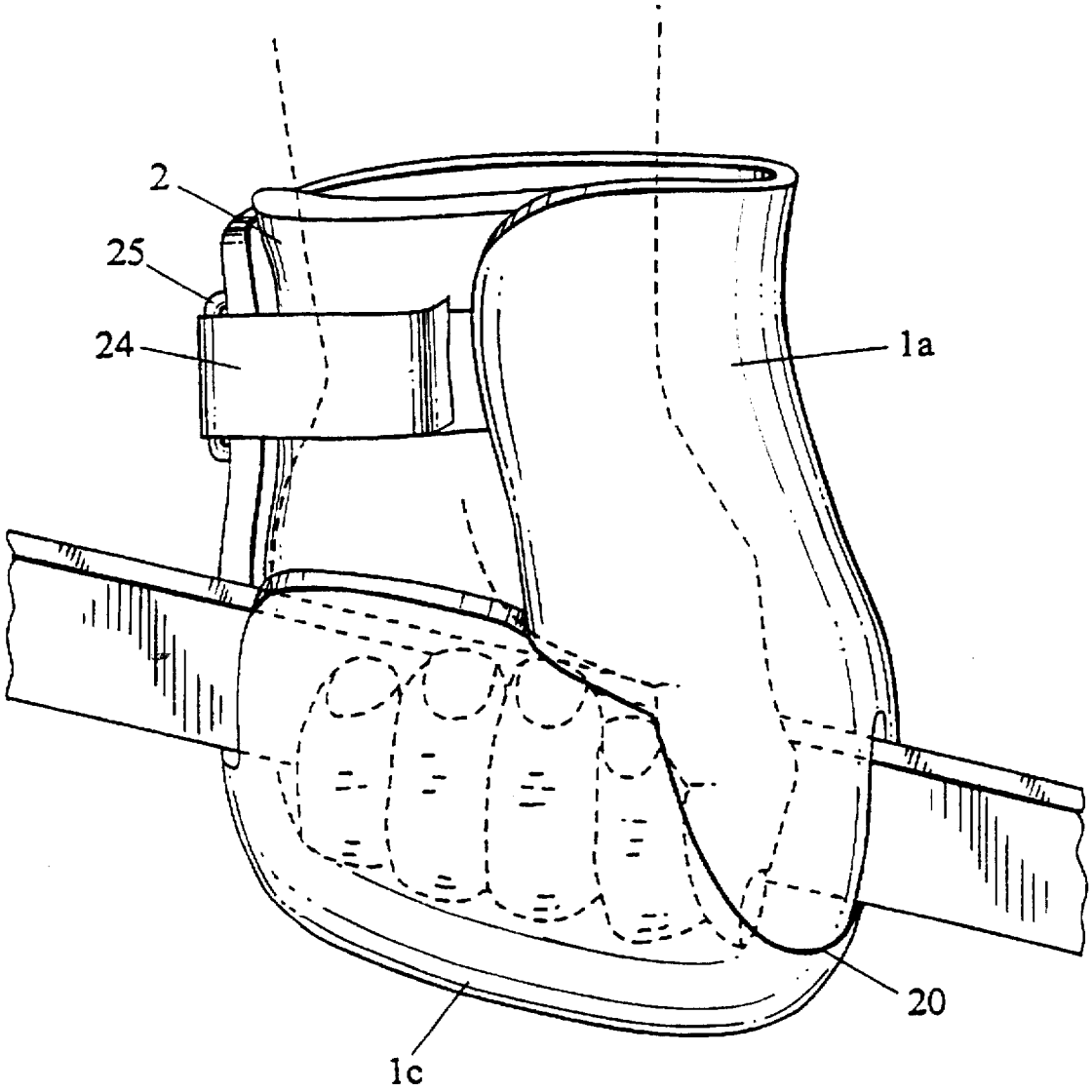
FIG. 9 shows the position of the hand within the protective shell in dashed lines.

The notch or joint region 10, 11 is so constructed that the padding elements 1*b*, 1*c* can slide into padding elements 1*a*, 1*b* when opening the hand (see FIGS. 4 and 5). The bending axes are so formed that the leather or fabric strips 12, 13 connect the padding elements 1*a*, 1*b*, 1*c*. As a result of this design of the joints, hardly any force need be expended when closing and opening the hand. In addition, complete protection without gaps is achieved.

Figure 1:
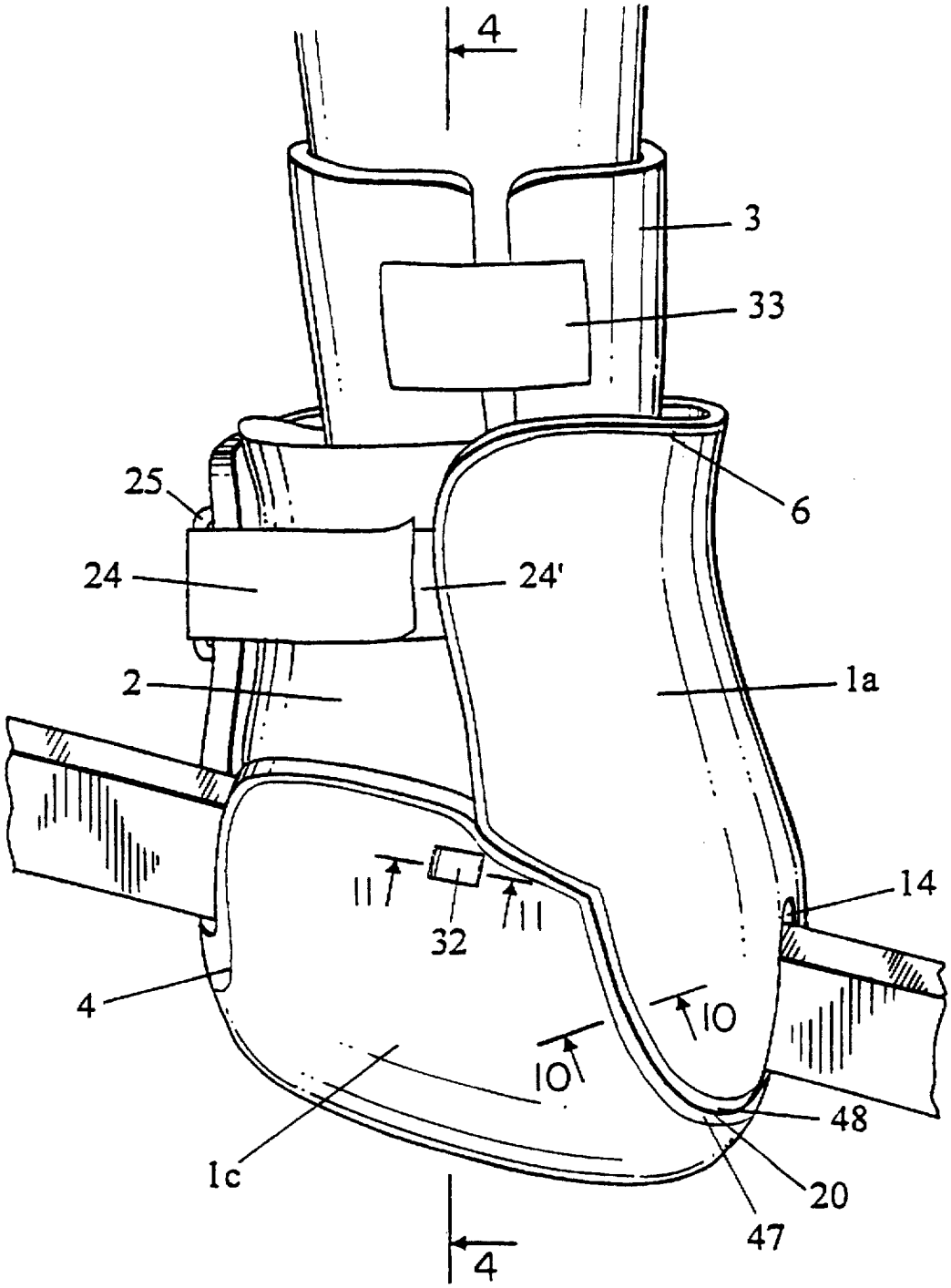
FIG. 1 shows an inner view of a closed protective glove in a first embodiment.
Figure 3:
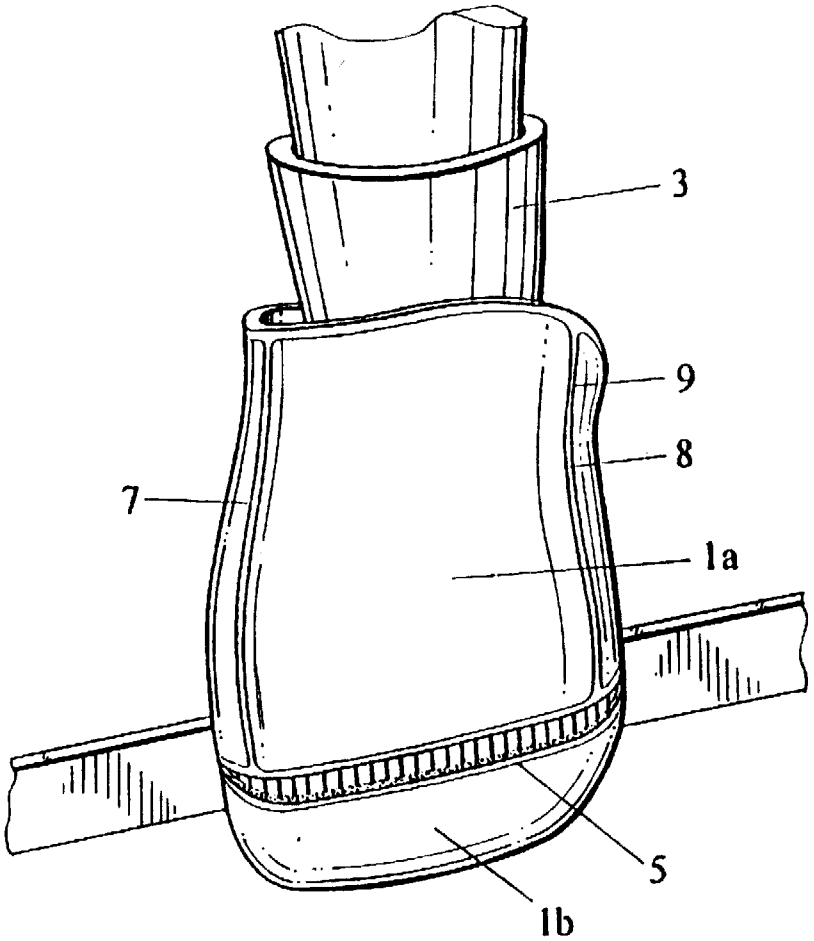
FIG. 3 shows a rear view of the closed protective glove according to FIG. 1.
Figure 2:
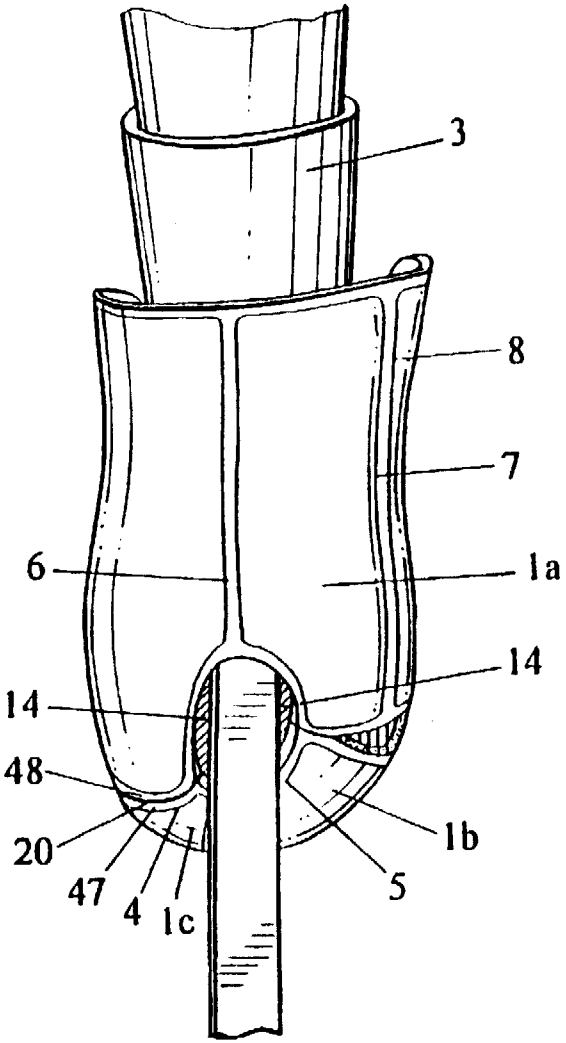
FIG. 2 shows a side view of the closed protective glove according to FIG. 1.
Figure 10:
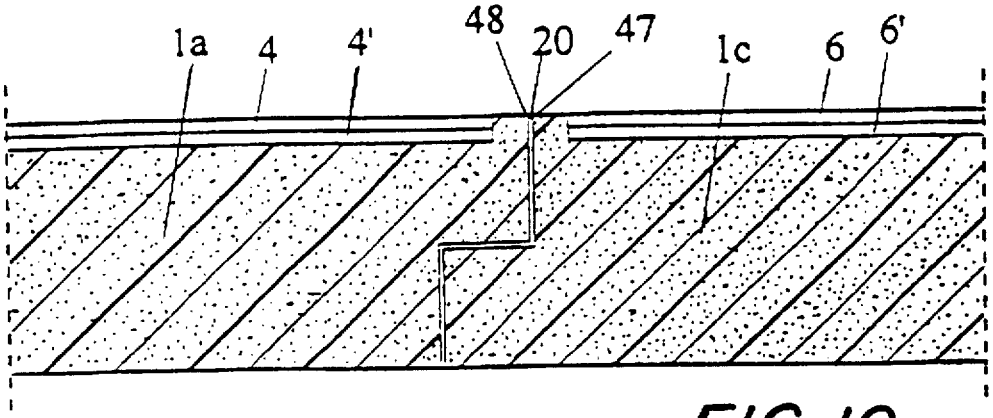
FIG. 10 shows a section 10—10 from FIG. 1 illustrating the meshing of the padding elements of the thumb and finger.

The external shape of the padding 1 will be seen from FIGS. 1, 2, 3. In principle, it is designed in such a way that the hand is completely surrounded by the padding 1 when making a fist or holding a hockey stick. The padding element 1*a* for the back of the hand and thumb which forms one piece and has an opening 14 for the stick fits exactly into the finger padding element 1*c* so that the cleft 20 (FIGS. 1 and 2) is closed substantially without gaps along its entire length when the hand is closed (see FIGS. 5, 6, 7 and 10). The cleft 20 can also be designed in such a way that the edges 47, 48 fit in one another in a folding manner. Such a variant is shown in FIG. 10 which shows section B—B from FIG. 1.

Figure 21:
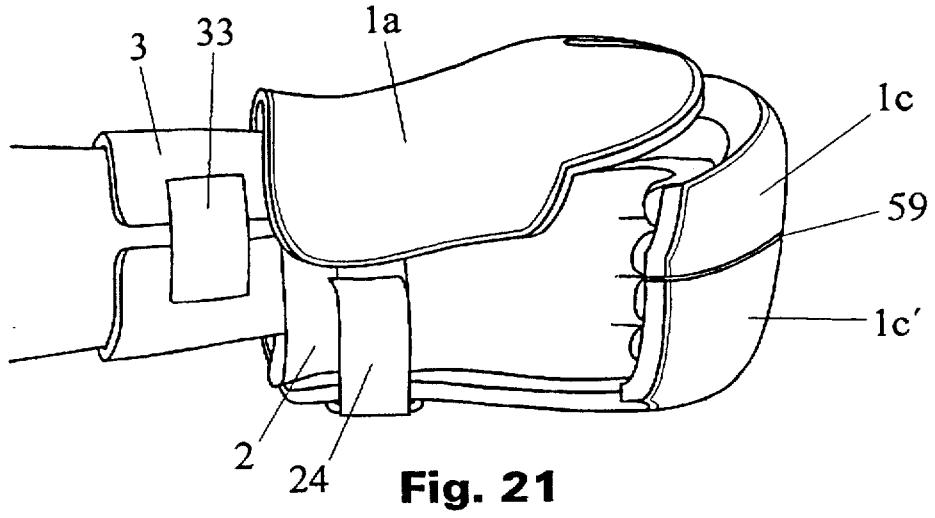
FIG. 21 shows the protective glove with a padding member for the fingers is formed of two elements divided in a longitudinal direction of the fingers.

The protection of the index, middle, ring and little fingers is formed by two padding elements 1*b*, 1*c* so that blows occurring in this region are also distributed over large surfaces and a good absorption of impact forces is achieved. Accordingly, the padding 1, in its entirety, is formed of only three padding elements 1*a*, 1*b*, 1*c* (FIG. 4) which can be foamed within comparatively simple casting molds at a low cost in labor. Another advantage consists in that the plates 4, 5, 6, 7, 8, 9 can be placed in the casting mold before foaming and are embedded in the foamed material so as to fit exactly. The padding elements 1*b*, 1*c* can be divided into two elements in the longitudinal direction of the fingers along a line 59, as shown in FIG. 21.

Figure 11:
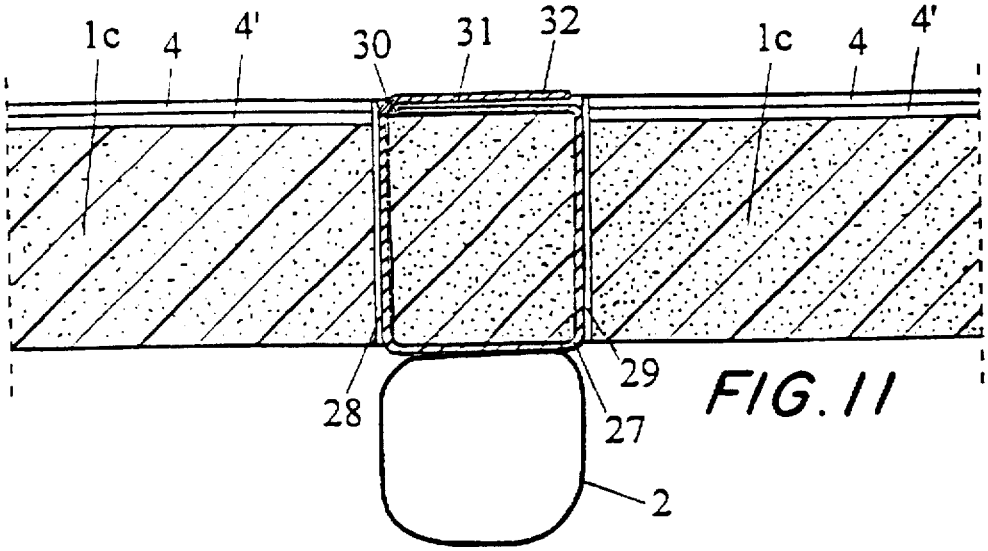
FIG. 11 shows a section 11—11 from FIG. 1 illustrating the connection of the middle finger with the padding element.
Figure 20:
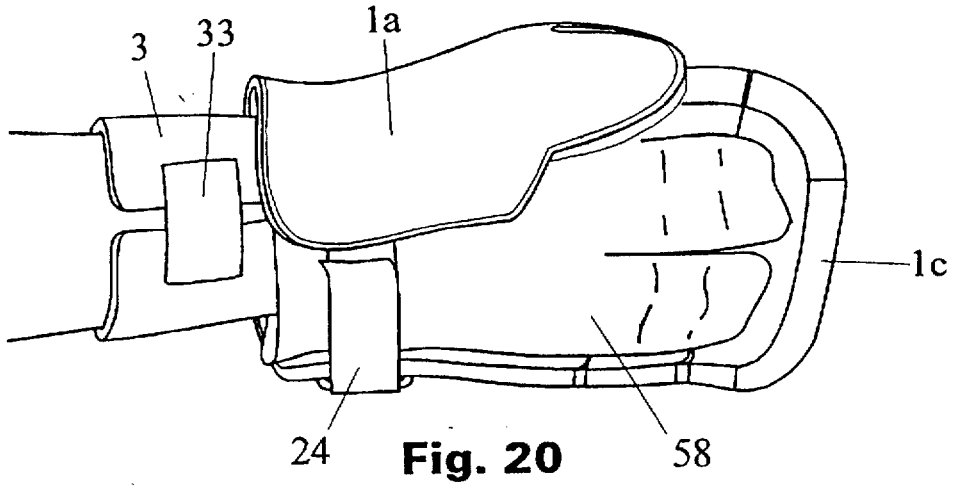
FIG. 20 shows the protective glove with an inner glove configured to hold two fingers together.

The inner glove 2 is made of fine leather or a similar material and, in form, resembles a conventional glove provided with fingers. The inner glove 2 can also be fingerless 57, as shown in FIG. 19, or can be a glove 58 configured to hold two fingers together, as shown in FIG. 20. It is connected with the padding 1 by Velcro strips 21, 22 in the back region (see FIG. 4) and by a Velcro strip at the tip of the thumb. Further, the inner glove 2 is secured at the inside of the hand by a Velcro part 23 at a strap 24 (see FIGS. 1 and 4). The strap 24 is stitched to the inner side of the padding element 1*a* in the region of the ball of the thumb and is guided through an elongated eyelet 25. The connection between the middle finger and padding element 1*c* is illustrated in FIG. 11 which shows section C—C from FIG. 1. The textile strip 27 is securely stitched to the middle finger part of the inner glove 2 and is guided through the slits 28 and 29 in the padding element 1*c*. The ends of the textile strips 31, 32 are fastened to one another in the recess 30 by Velcro parts.

The forearm protection 3 is constructed of two layers in this embodiment. On the outer side, a comparatively rigid material serves to distribute pressure, while a soft foamed material on the inner side acts as a cushion. It is held by a strap 33 which is provided with a Velcro part.

Figure 12:
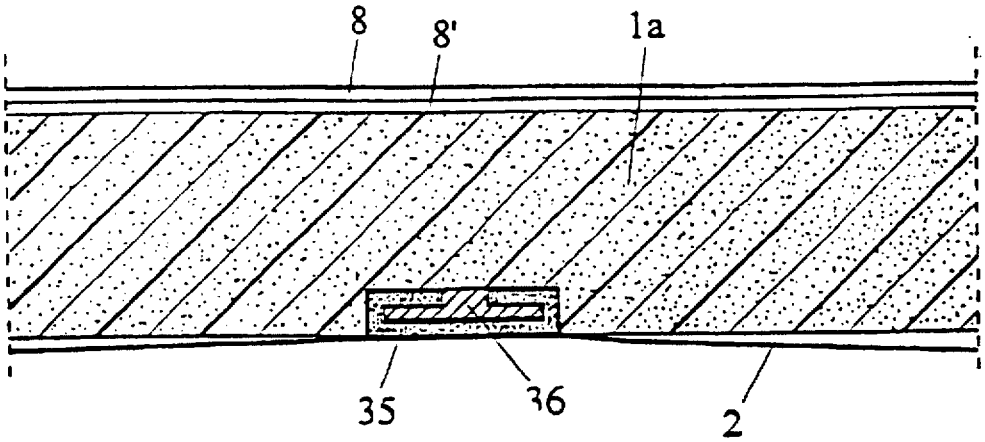
FIG. 12 shows a partial section through the back of a glove in a second embodiment form with a tongue-and-groove fastening.

In principle, there are two possible ways to put on and take off the protective glove formed of padding and an inner glove. In the first possibility, the inner glove remains in the padding when the protective glove is put on or taken off and is only removed for drying or to change it. This variant is represented by the ice hockey glove which was described in the first embodiment example according to FIGS. 1 to 9. In the second possibility, the user first puts on the inner glove and only then slips the hand into the padding. This variant is designed in the following manner:

A flat profile 35 (FIG. 12) is fastened in the longitudinal direction of the finger at the back of the inner glove 2. This profile 35 is preferably formed of a rigid plastic, e.g., ABS plastic. The counter-piece 36 complementing the profile 35 is made of the same material and is securely anchored in the foamed material of the padding element 1*a*. In other respects, the padding 1 is designed like the first embodiment example. The length of the profiles 35 and 36 is preferably so dimensioned that they extend from the rear end of the padding 1 to the proximal phalangeal region.

Figure 16:
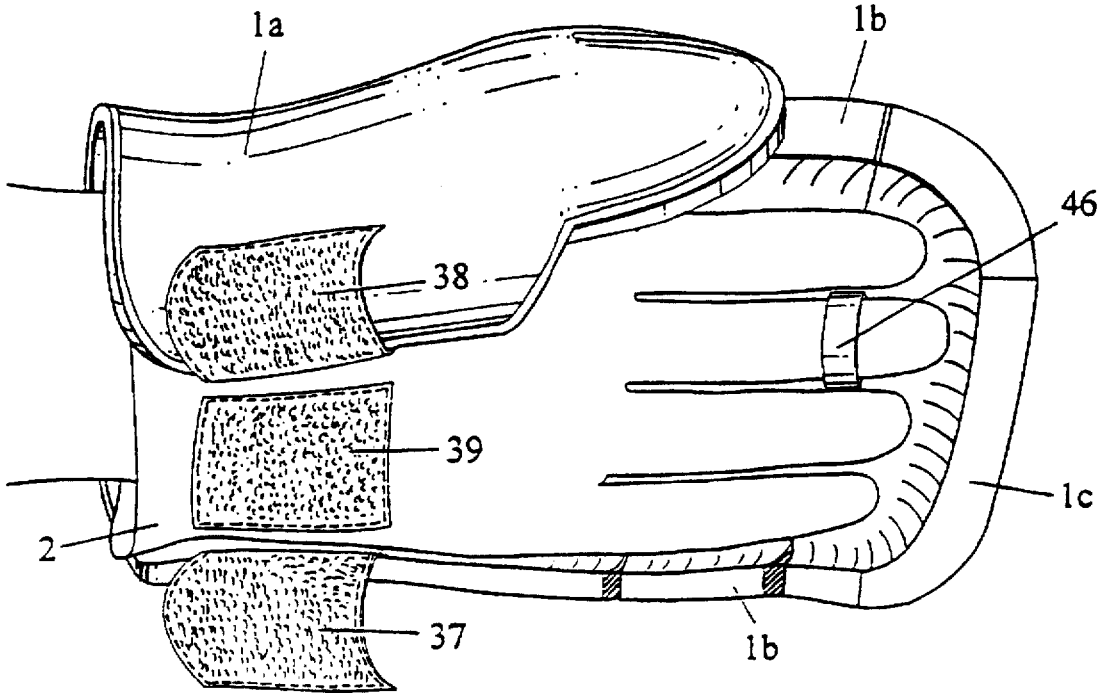
FIG. 16 shows a view as in FIG. 6 of the connection points between the inner glove and padding.

Additional connection points are formed by a loop for the thumb and a loop for the middle finger 46 in the interior of the padding 1 (see FIG. 16). Further, a connection is formed between the padding 1 and the inner glove 2 by Velcro tongues 37 and 38 at the inner side of the hand, which connection can easily be detached by the user to remove the protective glove.

The process of putting on the glove can be summarized as follows: the user first puts on the inner glove 2 and then slides the profile 35 of the inner glove 2 into the counter-piece 36 of the padding 1, simultaneously slipping the thumb and middle finger into the loops provided for this purpose at the interior of the padding 1. Finally, the user connects the Velcro tongues 37 and 38 with the corresponding Velcro part 39 of the inner glove 2.

The advantage of an ice hockey glove constructed in this way consists in that the player can use a very snug, well-fitting inner glove—in the manner of a golf glove—which has a very positive influence on sensitivity for controlling the stick.

Figure 17:
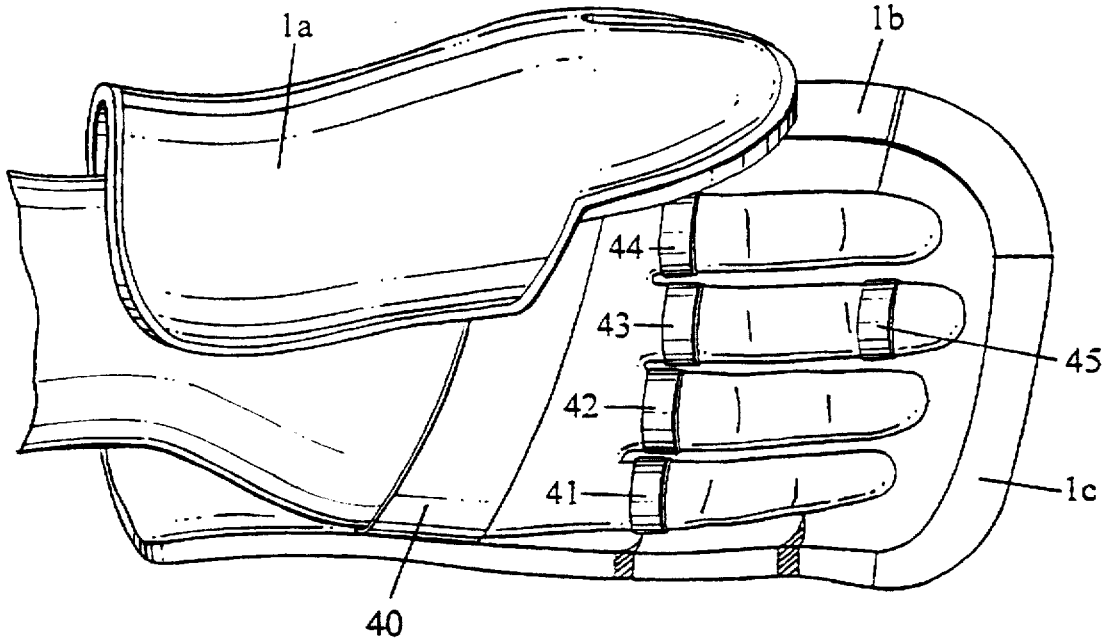
FIG. 17 shows an inner view of a protective glove in a third embodiment form with opened hand.

In a third embodiment form (see FIG. 17), no inner glove is used. Instead, the connection between the padding 1 and the hand is effected by straps and loops. The shape of the padding 1 is preferably designed in the same way as in the first two embodiment forms. There are many possible variations for the arrangement of the straps and loops. However, they are preferably constructed as shown in FIG. 17. The strap 40 is formed of an elastic material, extends obliquely along the palm of the hand and forms the principle connection between the padding and the hand. The loops 41, 42, 43, 44 are arranged in the proximal phalangeal region of the hand. Loop 45 forms the connection between the finger protection and the middle finger and causes the finger protection to be carried along by the finger movement when gripping the shaft of the stick. Further, another loop is provided for the thumb (not visible in FIG. 17).

The advantage of this embodiment variant consists in that it produces direct contact between the hand and the stick so that the stick can be guided with great sensitivity.

In the first two embodiment forms it is also possible to construct the back surface of the inner glove and, if need be, also the backs of the fingers in the form of a thin padding 56, as shown in FIG. 18. In so doing, it would be practical for this padding in the form of foamed material or the like to be softer than the padding of the protective shell so as to enable a further improvement in the distribution of impact force.

Figure 13:
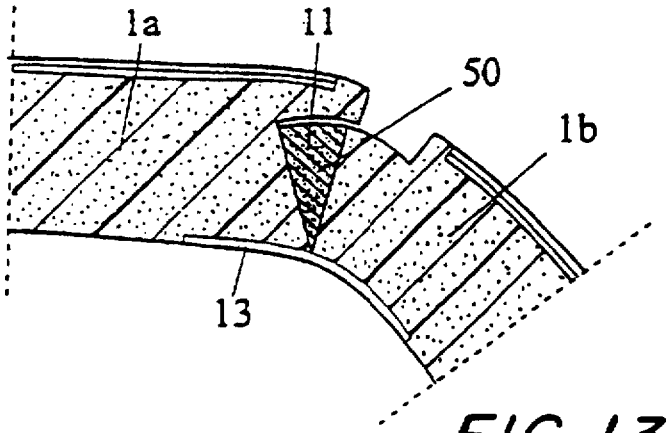
FIG. 13 shows a partial section in the region of the notches and joints in a first construction with a foam rubber wedge.

Another improvement possibility consists in filling the region of the notches and joints with a foam rubber wedge 50 as is shown in FIG. 13. In this way the protective shell can be kept "closed" and the user need only apply a certain force when stretching the finger, e.g., to grip the shaft of the stick. Accordingly, it is conceivable that a protective glove constructed in this way can also be used without any connection between the middle finger and protective shell.

Figure 14:
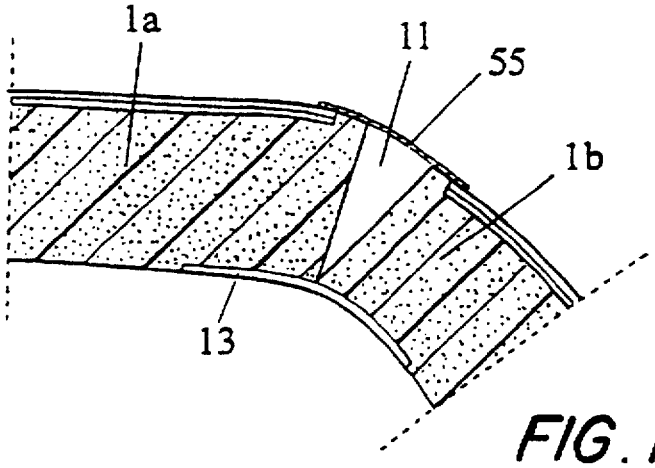
FIG. 14 shows a section as in FIG. 13 in a second construction with stretch-over leather when the fingers are closed.
Figure 15:
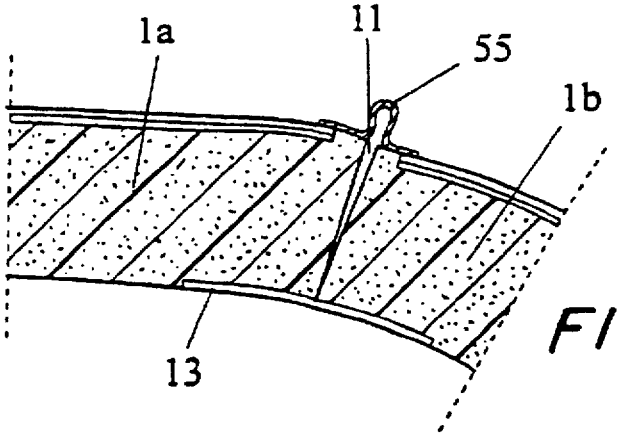
FIG. 15 shows a section as in FIG. 13 in a second construction with stretched-over leather when the fingers are opened.

A further possibility for improving the design of the notches is shown in FIGS. 14 and 15. In this case, a leather or fabric part 55 stretches over the notch. This prevents the thin blade of the stick of an opponent from penetrating into the notch and causing injury when the hand is closed. The leather or fabric part 55 can curve up easily when opening the hand as is shown in FIG. 15.

Figure 22:
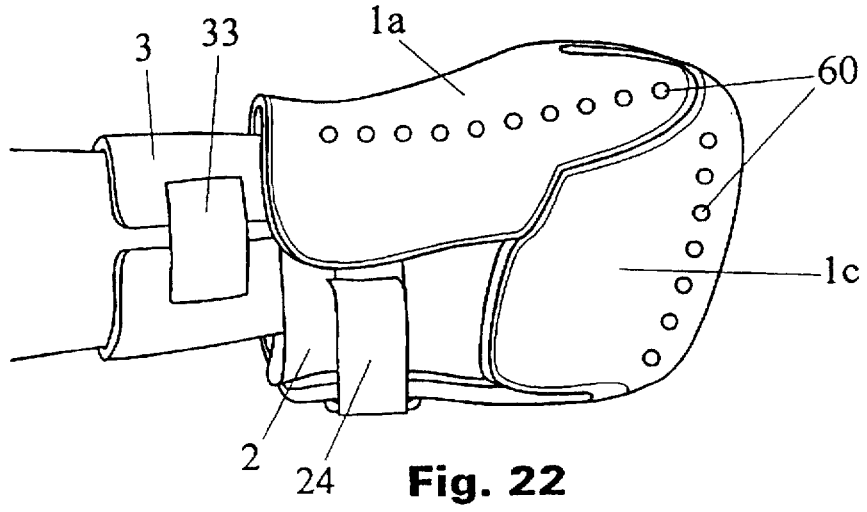
FIG. 22 shows the protective glove with ventilation holes in the padding member.

A final improvement of the ice hockey glove is possible in the region of the protective shell. Since ice hockey is played to an increasing extent during the summer months and the proposed protective glove can also be used for roller hockey or street hockey, it can be very advantageous to provide the protective shell with a plurality of holes 60 as shown in FIG. 22. This would improve ventilation of the hands without significantly impairing the protective function. The diameter of the holes would range between approximately 5 and 12 mm. The reduction in weight which is achieved in this way is a secondary benefit.

I claim:

1. A protective hockey glove for a hand, comprising: a first stiff padding member molded for the fingers; a second stiff padding member molded for the thumb of the hand, the padding members being configured in a region of contact between the thumb and index finger so that when the hand is closed to grip a stick edges of the padding members fit together substantially without gaps along a defined line of contact to form an opening for the stick; and outwardly directed hinge means for connecting the first padding member to the second padding member so that the index finger can be moved toward the thumb, the hinge means running transverse to a longitudinal direction of the fingers.

2. A protective glove according to claim 1, wherein the first padding member for the index, middle, ring and little fingers is a single part that is moveable in a proximal phalangeal region of the hand and is guidable by one of the fingers.

3. A protective glove according to claim 1, wherein the first padding member for the index, middle, ring and little fingers is divided transversely to the longitudinal direction of the fingers into two molded padding member parts, and further comprising additional hinge means for connecting together the padding member parts of the first padding member to enable bending of the hand.

4. A protective glove according to claim 1, wherein the hinge means includes at least one notch having a meshing fold construction.

5. A protective glove according to claim 4, and further comprising a woven fabric member arranged to stretch over the at least one notch.

6. A protective glove according to claim 4, and further comprising a leather member arranged to stretch over the at least one notch.

7. A protective glove according to claim 1, wherein the second padding member is an individual mold-formed part for the thumb and back of the hand.

8. A protective glove according to claim 1, wherein the glove is configured to have no palm region, and further comprising a plurality of straps and loops connected to an inner side of the padding to accept the hand.

9. A protective glove according to claim 1, wherein the padding members are configured to overlap in a folding manner in a region between the thumb and index finger when the hand is closed so that an essentially smooth transition exists between the padding members.

10. A protective glove according to claim 1, wherein the first padding member for the index, middle, ring and little fingers is formed of at least two elements divided in the longitudinal direction of the fingers.

11. A protective glove according to claim 1, and further comprising an exchangeable inner glove that is detachably connected to the padding, and means for detachably fastening the inner glove to the padding.

12. A protective glove according to claim 11, wherein the fastening means includes hook and latch type fasteners connected to the inner glove and the padding members to permit releasable connection therebetween.

13. A protective glove according to claim 11, wherein the fastening means includes snaps.

14. A protective glove according to claim 11, wherein the fastening means includes a sliding connection comprised of a profile member on one of the padding members and the inner glove, and a counter-profile member arranged on the other of the padding members and the inner glove so that the profile member and counter-profile member are slidably engageable.

15. A protective glove according to claim 11, wherein the inner glove is configured without fingers.

16. A protective glove according to claim 11 and further comprising a thin padding on the inner glove in a region corresponding to at least one of the back of the hand and the back of the thumb.

17. A protective glove according to claim 11, wherein the inner glove is configured to hold at least two fingers together.

18. A protective glove according to claim 3, and further comprising a resilient wedge arranged in the at least one notch so as to facilitate closing of the glove.

19. A protective glove according to claim 1, and further comprising foam-imbedded, comparatively rigid plates connected to an outer side of the padding members.

20. A protective glove according to claim 1, wherein the padding members have holes therein for ventilation.

* * * * *